United States Patent [19]

Yamamoto

[11] Patent Number: 4,475,415

[45] Date of Patent: Oct. 9, 1984

[54] OUTSIDE DOOR HANDLE

[75] Inventor: Kazumasa Yamamoto, Tokyo, Japan

[73] Assignee: Kokusan Kinzoku Kogyo Kabushiki Kaisha, Tokyo, Japan

[21] Appl. No.: 336,609

[22] Filed: Jan. 4, 1982

[51] Int. Cl.[3] ..... G05G 1/10

[52] U.S. Cl. ..... 74/543; 74/526; 292/336.3; 292/347; 16/374

[58] Field of Search ..... 74/543, 526; 292/336.3, 292/347, 216, 280; 16/374, 376, 371

[56] References Cited

U.S. PATENT DOCUMENTS

| | | | |
|---|---|---|---|
| 1,337,817 | 4/1920 | Bode | 16/374 |
| 2,665,156 | 1/1954 | Allen | 292/216 |
| 3,007,348 | 11/1961 | Barnes | 74/543 |
| 3,795,416 | 3/1974 | Hehl et al. | 292/336.3 |
| 3,799,596 | 3/1974 | Nozumu et al. | 292/216 |
| 3,848,909 | 11/1974 | Foley | 292/336.3 |
| 3,858,921 | 1/1975 | Kuki | 292/336.3 |
| 3,967,844 | 7/1976 | Torii et al. | 292/336.3 |

FOREIGN PATENT DOCUMENTS

| | | | |
|---|---|---|---|
| 596947 | 11/1925 | France | 16/371 |

*Primary Examiner*—Kenneth Dorner
*Assistant Examiner*—Anthony W. Raskob, Jr.
*Attorney, Agent, or Firm*—Fleit, Jacobson, Cohn & Price

[57] ABSTRACT

The invention resides in an outside door handle assembly which comprises a door handle pivotably mounted on a door of an automotive vehicle; and a door latch operating rod having an end portion which is pivotably attached to an extension of said door handle after assemblying thereto. A pair of finger projections are made integral with the door handle arm. There is provided a channel-shaped metal bracket fixedly attached to a door panel and pivotably mounting said finger projections. An inclined groove formed on each of the finger projections generally opening towards the two limbs of the bracket and adapted for receiving partially these limbs when said door handle arm has been brought into its upper service position, thereby torsional deflexion of the bracket as liably occuring during the door-opening operation being prevented effectively.

2 Claims, 11 Drawing Figures

OUTSIDE DOOR HANDLE

BACKGROUND OF THE INVENTION

The present invention relates to improvements in and relating to the door handle assembly, especially adapted for use on automotive vehicles. The handle of such door handle assembly is connected mechanically through a rather long rod with the door latch operating mechanism in such a way that when the door handle is raised manually upwards against spring action, the door latch is released, as is well known among those skilled in the art. When the operator releases his hand from the door handle, the handle is returned from the upper raised position to the lower regular one automatically by spring action.

The handle proper is provided rigidly with a pair of finger like projections which are connected in turn with a bracket made of a thin metal sheet having a channel-shaped overall configuration. This bracket has a pair of arms constituting the two limbs or chords which are connected at their tip ends with the said finger projections, respectively, at intermediate points thereof. This bracket is rigidly connected with the door panel. For release of the door latch, the handle proper or -arm is raised manually, as is very well known, against spring action and relative to the bracket and door panel, so as to pull up a lengthy operating rod which is pivotably connected at its upper end with one of the said finger projections substantially at its free end.

Upon release of the operator's hand from the door handle arm, the latter is automatically returned to its off-service normal position.

The operator will pull strongly the outside door handle arm towards him for operating the door upon release of the door latch in the above mentioned way and the bracket will liably receive a severe mechanical distorsion at the limbs or chords which may be subjected to permanent distorsion.

It is therefore to provide an improved outside door handle assembly in which the bracket is guarded from the subjection of permanent mechanical distorsion which gives rise to functional failure of the door handle return spring, as will be later more fully described.

This and further objects, features and advantages of the invention will become more apparent when the description progresses with reference to the accompanying drawings:

DETAILED DESCRIPTION OF THE INVENTION

Now referring to the accompanying drawings, substantially a preferred embodiment will be described in detail.

Numeral 1 represents a somewhat elongated door handle arm proper having a thickened edge 1*a* acting as a finger stop for easy manipulation of the door handle.

Symbols 2 and 3 are a pair of projecting arms or fingers which are made integral with the handle arm proper 1, somewhat different configurations from each other.

Figure 1:
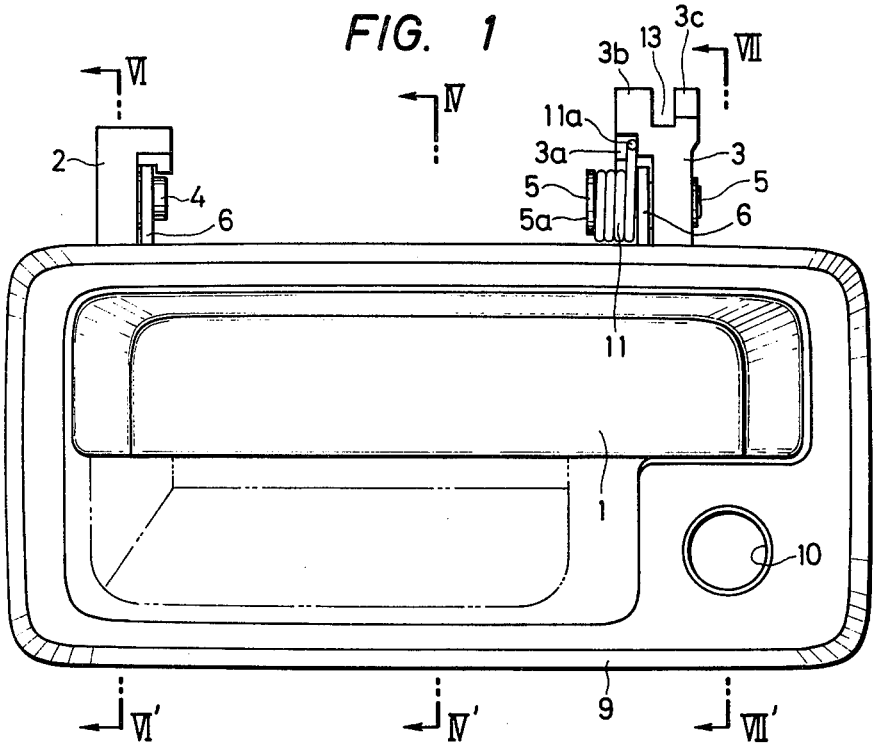
FIG. 1 is a front view of a preferred embodiment of the door handle assembly, however, without showing the door latch-operating rod to be pivotably attached thereto.
Figure 2:
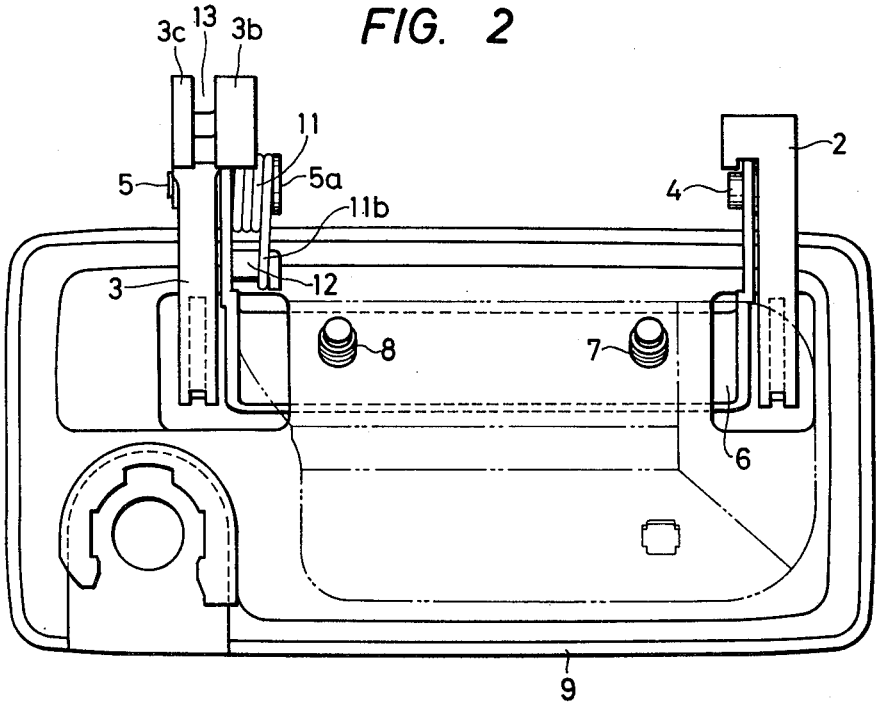
FIG. 2 is a rear side view of the door handle assembly shown in FIG. 1.
Figure 4:
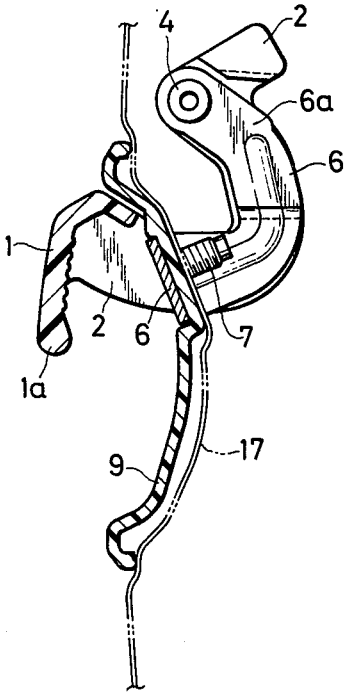
FIG. 4 is a cross-section taken along a section line IV—IV' in FIG. 1.
Figure 6:
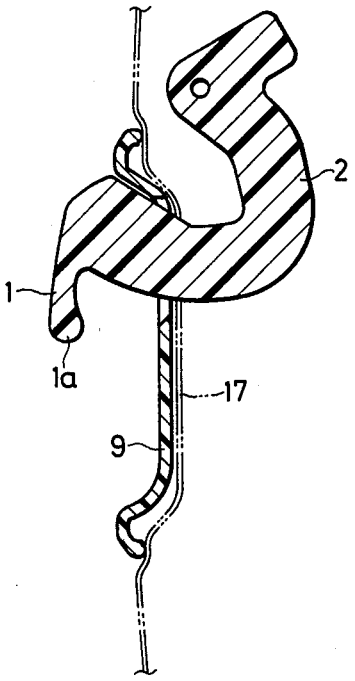
FIG. 6 is a cross-section taken along the section line VI—VI' shown in FIG. 1.
Figure 7:
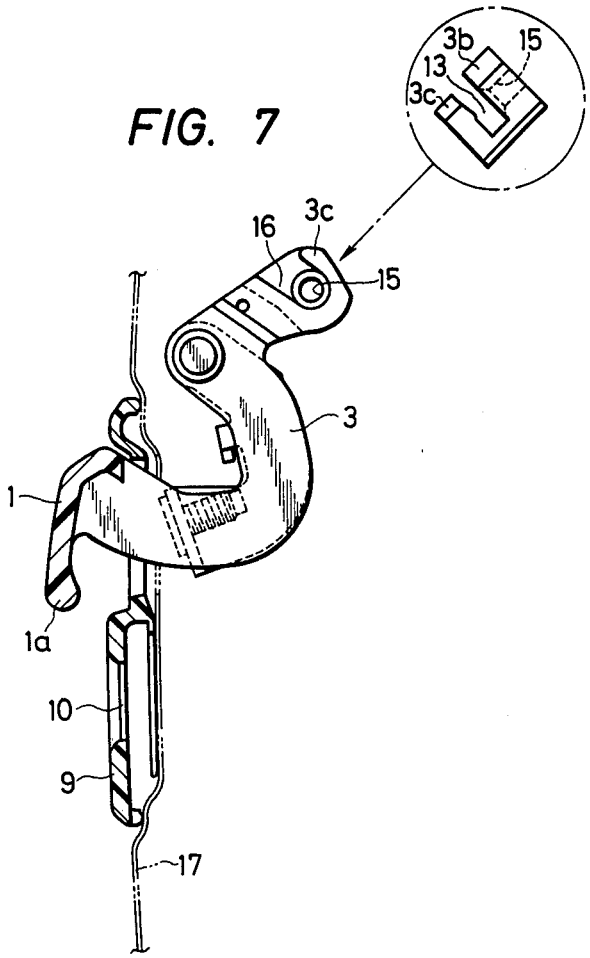
FIG. 7 is a cross-section taken along the section line VII—VII' shown in FIG. 1.
Figure 8:
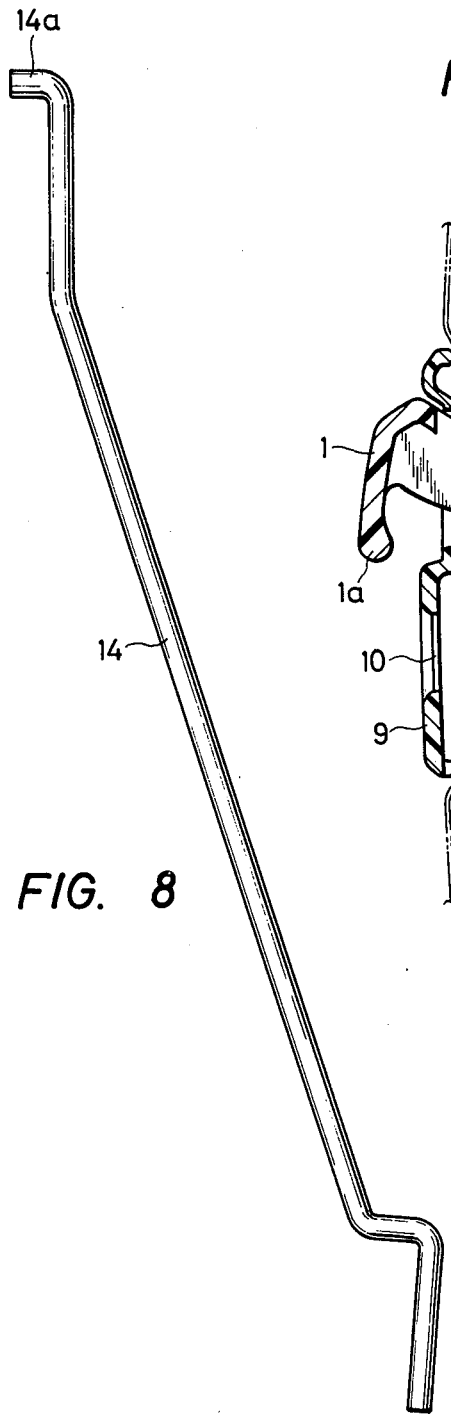
FIG. 8 is a side view of the door latch-operating rod.

The handle arm proper-and-projecting arm combination is pivotable at 4 and 5 relative to a bracket 6 rigidly connected at 7 and 8 with a housing piece 9 and a conventional automotive door panel which is not shown for avoiding possible confusion of the drawn parts and on account of its very popularity so far as FIGS. 1 and 2 are concerned. However, the door panel is shown at 17 in FIG. 4 and the like.

The housing piece 9 is formed with a hole 10 adapted for receiving a conventional cylinder lock, not shown.

The arm projection 3 is provided at its free end with the pivot pin 5 made rigid therewith by press job, as an example, said pin carrying thereon the body part of a return coil spring 11 having first extension 11*a* abutting against a shoulder 3*a* formed on the arm projection 3. The spring 11 has another extension 11*b* which abuts on a projection 12 extending rigidly from the bracket 6 (refer specifically to FIG. 2). The pivot pin 5 is formed at its inner end with an enlarged head 5*a* for the prevention of unintentional slip-out of the coil spring.

The free end of arm projection 3 is formed into two arm elements 3*b* and 3*c* so as to provide an idle space 13 therebetween for allowing a turning movement of the end bend 14*a* of latch-operating rod 14 when assemblying.

Inner arm element 3*b* is formed with a round opening 15 adapted for receiving the said rod end 14*a*. Outer arm element 3*c* has a hook shape so as to provide an introduction recess 16 which is adapted for introducing the rod end 14*a*, as will be later more fully described.

Figure 3:
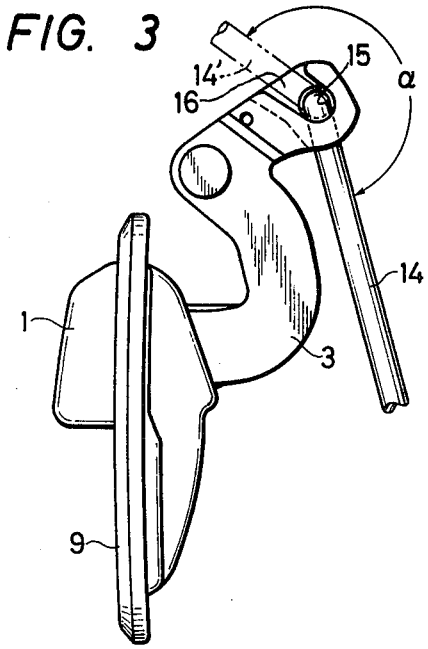
FIG. 3 is a side view of a handle arm-latch operating rod connection.
Figure 5:
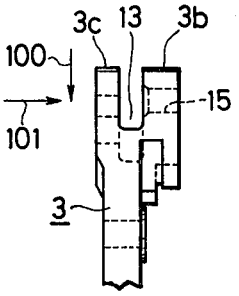
FIG. 5 is a detail front view of one of the handle arm projections which is adapted for receiving the top end of the latch operating rod.
Figure 9:
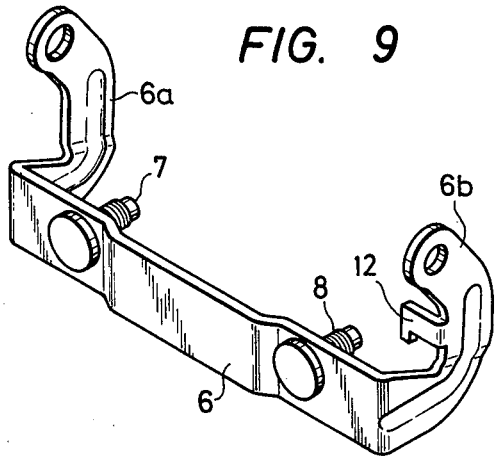
FIG. 9 is a perspective view of the bracket.

In assemblying of the outside door handle assembly, the sub-assembly shown in FIGS. 1 and 2 is assembled as conventionally. For attaching the door latch operating rod 14 thereto, the workman grips it by his hand substantially at the middle thereof, directing however its L-shaped end 14*a* substantially downwards, and introduces such rod end into the open groove 16 of the arm element 3*c* by sliding the L-arm portion along the side walls of the groove, until the L abuts on the bottom 16*a* of the latter, as hinted by an arrow 100 shown in FIG. 9. At this stage, the L-arm 14*a* points toward the hole 15 and is brought into registration therewith. Then, the operator exerts a light hand pressure onto the rod end 14*a* in the direction perpendicular and as shown by a further arrow 101 in FIG. 5, the L-arm of the rod 15 is inserted through the rod-receiving opening 15 and the body of rod 14 is brought into registration with idle space 13 between the both arm elements 3*b* and 3*c*. This position is schematically shown in chain-dotted lines 14' in FIG. 3. Finally, the rod 14 is turned, say alpha, 220 degrees in FIG. 3 around the rod's L-arm or the axis of opening 15, so as to bring the rod into its regular service position shown in FIG. 3 in full lines at 14. Naturally, the said rod-turning angle alpha, 220 degrees may be modified according to design.

Thus, the rod 14 can be set in a push-in and turning mode without execution of any additional afterfabrication. Therefore, according to this, the assembly job of the outside door handle with the latch operating rod can be highly simplified and economized.

The operational mode of the present outside door handle assembly is just same as conventional. By raising manually the handle arm 1 upwards against the action of return coil spring 11, motion is transmitted therefrom through the rod 14 towards the latch operating mechanism, not shown, for release of the door latch, again not shown.

Figure 10:
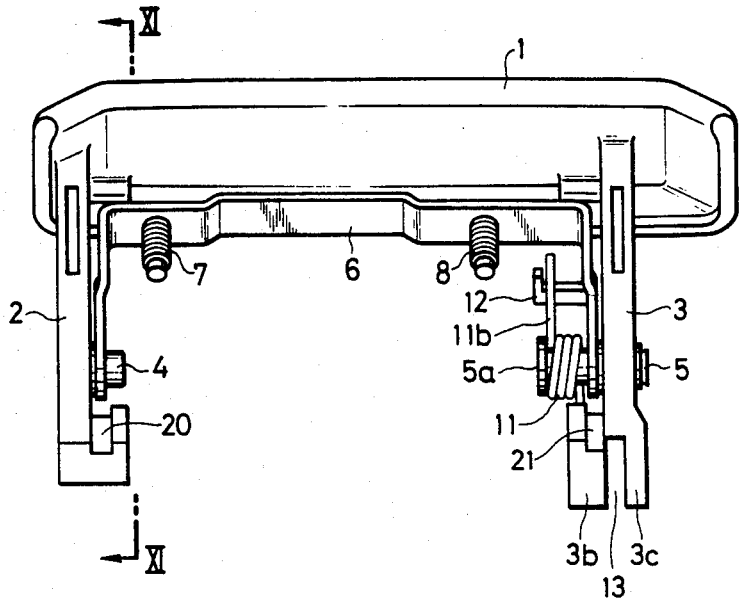
FIG. 10 is a front view of a subcombination of the outside door handle arm with the bracket pivotably connected with each other, the door panel being omitted from showing.
Figure 11:
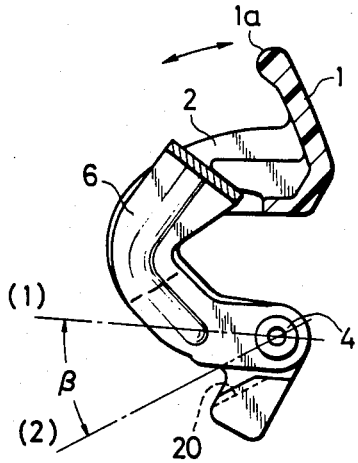
FIG. 11 is a cross-section taken along a section line XI—XI' shown in FIG. 10.

As most clearly be seen from FIGS. 10 and 11, the finger projections 2 and 3 integral with the handle arm 1, is formed with inclined grooves 20 and 21 generally opening towards the bracket limbs, respectively. These grooves are so directed and arranged that the handle arm is raised from its normal off-service position to its service position as above mentioned, the end portions of limbs or chords 6*a* and 6*b* of bracket 6 are brought into engagement with these grooves 20 and 21, respectively, and thus the said limbs are effectively prevented from torsional deflection or deformation. By release of the operator's hand from the outside door handle, the latter is brought to its off-service position shown in FIGS. 1 and 2.

The embodiments of the invention in which an exclusive property or privilege is claimed are as follows:

1. An outside door handle assembly, said handle comprising:

a door handle mounted on a door of an automotive vehicle;

a pair of finger projections extending from and being integral with said door handle;

a channel-shaped bracket fixedly attached to a door panel;

two limbs extending from and being integral with said bracket, each of said limbs pivotably connected at an end portion furthest from said bracket to said finger projections, said finger projections being connected at intermediate points to said limbs; and an inclined groove formed in each end of said finger projections, said ends of said finger projections being furthest from said door handle, said inclined grooves opening towards said end portions of said limbs and said inclined grooves adapted for receiving partially said end portions of said limbs when said door handle has been brought to an upper service position, thereby effectively preventing torsional deflection and deformation of said door handle.

2. A door handle as claimed in claim 1, further comprising an operating rod pivotably connected at said end of one of said finger projections.

* * * * *